US006715697B2

(12) United States Patent
Duqueroie

(10) Patent No.: US 6,715,697 B2
(45) Date of Patent: Apr. 6, 2004

(54) DEVICE FOR DISPENSING A FLUID PRODUCT AND METHOD OF DISPENSING A FLUID PRODUCT

(75) Inventor: Florent Duqueroie, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 10/177,135

(22) Filed: Jun. 24, 2002

(65) Prior Publication Data

US 2003/0010795 A1 Jan. 16, 2003

(30) Foreign Application Priority Data

Jun. 22, 2001 (FR) ..... 01 08280

(51) Int. Cl.[7] ..... B65D 1/32

(52) U.S. Cl. ..... 239/327; 239/326; 239/323; 239/309; 222/630; 222/631; 222/107

(58) Field of Search ..... 222/212, 630, 222/631, 632, 92, 107, 95, 494; 239/327, 326, 309, 323, 328, 329, 147

(56) References Cited

U.S. PATENT DOCUMENTS

| | | | | | |
|---|---|---|---|---|---|
| 3,412,907 | A | | 11/1968 | Faso | |
| 3,583,602 | A | | 6/1971 | Gruber et al. | |
| 3,897,005 | A | | 7/1975 | Reiner | |
| 3,949,934 | A | * | 4/1976 | Goglio | 383/103 |
| 4,275,840 | A | | 6/1981 | Staar | |
| 4,328,912 | A | * | 5/1982 | Haggar et al. | 222/212 |
| 4,513,891 | A | * | 4/1985 | Hain et al. | 222/213 |
| 4,568,004 | A | * | 2/1986 | Goncalves | 222/207 |
| 4,964,852 | A | * | 10/1990 | Dunning et al. | 604/75 |
| 5,129,550 | A | | 7/1992 | Eschbach | |
| 5,662,271 | A | * | 9/1997 | Weston et al. | 239/321 |
| RE35,683 | E | * | 12/1997 | Varlet | 53/420 |
| 5,839,609 | A | * | 11/1998 | Zakensberg | 222/107 |
| 6,264,067 | B1 | * | 7/2001 | Lasserre | 222/108 |
| 6,460,781 | B1 | * | 10/2002 | Garcia et al. | 239/327 |
| 6,478,195 | B2 | * | 11/2002 | Duquet et al. | 222/183 |

FOREIGN PATENT DOCUMENTS

| | | |
|---|---|---|
| BE | 870 592 | 1/1979 |
| EP | 0 761 314 | 3/1997 |
| FR | 2 443 980 | 7/1980 |
| FR | 2 778 639 | 11/1999 |
| WO | WO 99/59881 | 11/1999 |
| WO | WO 01/81184 | 11/2001 |

OTHER PUBLICATIONS

Co–pending Application—Attorney Docket No. 05725.1074–00000 Title: Device for Dispensing a Fluid Product and Method of Dispensing a Fluid Product Inventor: Florent Duqueroie U.S. Filing Date: Jun. 24, 2002.

English language Derwent Abstract of BE 870 592, Jan. 15, 1979.

English language Derwent Abstract of EP 0 761 314, Mar. 12, 1997.

English language Derwent Abstract of FR 2 778 639, Nov. 19, 1999.

* cited by examiner

*Primary Examiner*—Gene Mancene
*Assistant Examiner*—Azy Kokabi
(74) *Attorney, Agent, or Firm*—Finnegan, Henderson, Farabow, Garrett & Dunner, LLP.

(57) ABSTRACT

A device for dispensing a fluid product includes a reservoir configured to contain a fluid product and a spray orifice associated with the reservoir. The reservoir may include at least one actuating zone having a predetermined threshold resistance to deformation. The actuating zone may be configured to deform in response to pressure exerted on the actuating zone so as to cause the product to be sprayed out from the orifice. When pressure exerted on the actuating zone is less than a threshold pressure $P_s$ sufficient to overcome the predetermined threshold resistance to deformation of the actuating zone, substantially no portion of the product is sprayed from the spray orifice. Actuating zone deformation resulting from exertion of at least the threshold pressure $P_s$ on the actuating zone may persist when the pressure exerted ceases.

41 Claims, 2 Drawing Sheets

DEVICE FOR DISPENSING A FLUID PRODUCT AND METHOD OF DISPENSING A FLUID PRODUCT

BACKGROUND OF THE INVENTION

1. Field of the Invention

The present invention relates to a device for dispensing a product, for example, a fluid product, in the form of a spray. In one example, the device could be configured to dispense a miniature spray of one or more cosmetic products and/or care products, for example, a product comprising at least one substance for imparting a scent.

2. Description of the Related Art

Examples of some dispensers are generally described in the following patent applications: FR-A-2 778 639, EP-A-0 761 314, FR-A-2 443 980; in U.S. Pat. Nos. 3,897,005, 3,412,907; and BE 870 592. These devices generally suffer from at least one principal drawback, such as, for example, cost of manufacture, difficulty to use, or inability to generate a quality spray.

For example, for dispensers that contain samples of products that are generally not intended for sale, it is sometimes desired to keep the cost of manufacture as low as possible. In such dispensers, it may be important for the devices to include parts which can be produced easily by mass production and which can be assembled in a simple manner. Furthermore, it is sometimes desired for dispensers to be capable of generating a spray possessing good quality and consistent characteristics. It may also be desirable for dispensers to generate a relatively gentle spray for a certain duration, so that the spray may possess characteristics similar to the spray of an aerosol-type spray.

One solution for producing dispensers at a lower cost might include producing a reservoir in the form of a dosing bottle, for example, a dosing bottle of the type sometimes used for dispensing some physiological serums, eye ointments, and/or makeup removing products. Such a dosing bottle may be formed in a single piece, for example, with a spray orifice which may be opened by pulling off an endpiece (e.g., by twisting the endpiece off about the axis of the spray orifice). Such a dispenser may be filled via an open bottom in the reservoir. The open bottom may then be sealed, for example, by welding, in a manner similar to welding the end of a tube.

Such a solution may, however, suffer from two major drawbacks. A first drawback may arise from the fact that upon opening, the spray orifice resulting from pulling-off the endpiece (e.g., by twisting) may have an imprecise shape and size. This may result in the spray characteristic varying greatly from one device to another when compressible walls of the reservoir are pressed to initiate spraying. In some instances, the cross section of the orifice may be such that it is not possible to generate a spray. In such instances, the product may be able to flow out of the dispersing orifice only in the form of droplets of a greater or lesser size, or in the form of a continuous stream, rather than in the form of a spray.

A second drawback may be found, for example, in the welding operation. For example, in a dispenser containing a highly volatile product such as a scent, there is a risk that the product will evaporate when subjected to the heat associated with a welding process. The product may even deteriorate or ignite, as is the case for the dispenser described in Patent BE 870 592.

One subject of the invention relates to a dispenser, for example, a spray device, which may fully or partly obviate one or more drawbacks associated with the related art. Another subject of the invention relates to a device which may be easy to mass-produce in a cost-effective manner. Another subject of the invention concerns a device which may render it possible to generate a spray of satisfactory quality which may be consistently reproducible from one device to another. A further subject of the invention pertains to a device that may be capable of generating spray for a certain duration, and that may be capable of obtaining a relatively gentle spray. These subjects are optional and exemplary. Other subjects might also be possible.

SUMMARY OF THE INVENTION

In the following description, certain aspects and embodiments will become evident. It should be understood that the invention, in its broadest sense, could be practiced without having one or more features of these aspects and embodiments. It should also be understood that these aspects and embodiments are merely exemplary.

In one aspect, as embodied and broadly described herein, the invention includes a device for dispensing a fluid product. The device includes a reservoir configured to contain a fluid product and a spray orifice associated with the reservoir. The reservoir may include one or more actuating zones having a predetermined threshold resistance to deformation. The actuating zone may be configured to deform in response to pressure exerted on the actuating zone so as to cause the product to be sprayed out from the orifice. Moreover, the actuating zone may be configured so that when pressure exerted on the actuating zone is less than a threshold pressure PS sufficient to overcome the predetermined threshold resistance to deformation of the actuating zone, substantially no portion of the product is sprayed from the spray orifice. The device may also be configured so that actuating zone deformation resulting from exertion of at least the threshold pressure $P_s$ on the actuating zone persists when the pressure exerted ceases.

As used herein, a zone having a "threshold resistance to deformation" means a zone configured in such a way that its deformation does not depend linearly on the pressure exerted on it in order to deform it, but entails the passing of a threshold. Thus, pressure exerted by a user on the actuating zone before the threshold pressure $P_s$ (i.e., the pressure necessary and sufficient to overcome the predetermined threshold resistance to deformation of the actuating zone) is reached, may cause some deformation of the zone which does not allow the product to be sprayed but which does allow energy to be built up so that when the pressure exerted by the user on the zone reaches the threshold pressure $P_s$, the zone deforms suddenly. The volume inside the reservoir is then reduced in such a way that an overpressure is suddenly created inside the reservoir. This overpressure allows the product to be expelled from the spray orifice in the form of a spray. In at least some embodiments, that spray may be a good quality spray.

As used herein, the term "spray" means to eject and/or disperse a substance (e.g., a liquid) in the form of a mass or cloud of droplets, or in a discontinuous stream of droplets, such as, for example, in an atomizing fashion where the substance is in the form of a fine mist of tiny particles and/or droplets. In one example, the "spray" could be in a form similar to that of perfume dispensed in small particles dispersed in the air. In another example, the spray could be in a form similar to that sometimes associated with aerosol dispensers.

In another aspect, the device may be configured so that deformation of the actuating zone causes the product to be sprayed from the spray orifice for a duration of at least 1 second. The device may also be configured to contain a sample dose of fluid product, and the device may further include the fluid product contained in the reservoir. For example, at least prior to a first use of the device, the product may have a volume ranging from about 0.5 milliliter to about 15 milliliters. The product may include at least one of a cosmetic product and a care product and such a product may have a volume that is a sample dose. For example, the product may include at least one component imparting a scent to the product. In some examples, the product may comprise at least one of a perfume and a cologne.

In another aspect, the device may be configured so that deformation of the actuating zone causes the product to be sprayed from the spray orifice for a duration ranging from about 1 second to about 45 seconds. For example, the device may be configured to so that deformation of the actuating zone causes the product to be sprayed from the spray orifice for a duration ranging from about 2 seconds to about 10 seconds. In such an exemplary embodiment, once the user has exerted the threshold pressure $P_s$, the user may not be required to maintain pressure on the deformed actuating zone in order to continue spraying the product. The product may be sprayed for a certain length of time (e.g., until the overpressure created inside the reservoir drops below the value required to bring about dispensing (e.g., in the form of a spray)), even when the user no longer exerts pressure on the actuating zone.

According to yet another aspect, the actuating zone may be provided with a substantially convex profile in an undeformed position and a substantially concave profile in a deformed position. The actuating zone may be configured to be deformed from an undeformed position to a deformed position, and the actuating zone may have a substantially convex profile (e.g., dome shape) in its undeformed position and a substantially concave profile in its deformed position. The deformed position may occur when the pressure exerted on the actuating zone reaches the threshold pressure $P_s$. The actuating zone may be at least partially defined by a line of material on the reservoir having a reduced thickness. Such a configuration may render it possible to easily obtain a zone with a threshold resistance to deformation which corresponds to the change between the concave profile and the convex profile.

In still another aspect, the actuating zone of the reservoir may be formed of at least one layer of at least one of a thermoplastic material and a metallic material. The thermoplastic material may be selected from polyethylenes, polypropylenes, polyethylene terephthalates, polyethylene naphthalates, polyacrylonitriles, polyoxymethylenes, and polyvinyl chlorides. This may result in making it easier to keep the actuating zone in the deformed position without maintaining pressure on the deformed zone.

In a further aspect, the reservoir may include a plurality of actuating zones. This may enable the user to spray the product contained in the reservoir in several hits. In addition, each of the plurality of actuating zones may be configured to deform in a substantially identical manner. In such a configuration, the user may be able to spray substantially identical doses of product from the device. In addition (or in the alternative), two or more of the actuating zones may be configured to deform in a substantially different manner from one another. In such a configuration, the overpressure generated when deforming a first actuating zone may be different from that generated when deforming a second actuating zone, and the doses of product sprayed may be different. With this configuration, the user may choose to spray a relatively large dose of product and then, for example, add one or more small doses to tailor application of the product.

In a further aspect, the device may be provided with a diffuser including, for example, a nozzle and the spray orifice. The nozzle may include at least one swirl-inducing duct. For example, a portion of the device defining the spray orifice may be configured to induce a swirl to product sprayed from the spray orifice. A swirl-inducing duct may render it possible to accelerate the fluid upstream of the spray orifice so as to produce very fine particles of liquid. The spray orifice could also be alternatively formed as a relatively simple nozzle. In addition, the diffuser may be mounted, for example, on the reservoir via one of snap-fastening and screw-fastening. Thus, when the reservoir is empty, such a diffuser may be removed so as to refill the reservoir in order to reuse the device. Alternatively, an intermediate element may be provided between the reservoir and the diffuser. The intermediate element may be, for example, an endpiece which may be mounted on the reservoir (e.g., by snap-fastening and/or screw-fastening). The diffuser may be mounted on the endpiece, for example, by bonding and/or welding (e.g., by applying heat).

In an additional aspect, the reservoir may define an interior volume in an undeformed state ranging from about 0.2 milliliter to about 15 milliliters. According to another aspect, the reservoir may define an interior volume in an undeformed state ranging from about 0.5 milliliter to about 10 milliliters. The reservoir may define an interior volume in a deformed state ranging from about 0.17 milliliter to about 14 milliliters, for example, from about 0.4 milliliter to about 9 milliliters. For example, the difference between an interior volume of the reservoir in an undeformed state and a deformed state may range from about 0.01 milliliter to about 2.25 milliliter, for example, from about 5% to about 15% of the interior volume of the reservoir in the undeformed state.

In still a further aspect, a portion of the reservoir opposite the actuating zone may define a substantially planar surface. In addition, the device may define a substantially tear-drop shape. At least a portion of the reservoir may be one of at least partially transparent and at least partially translucent, and/or the reservoir may include at least one substance imparting a color to the reservoir.

According to another aspect, the reservoir may include a first portion comprising the actuating zone and at least one other portion. In one embodiment of a device having such a configuration, when the threshold pressure $P_s$ is exerted on the first portion and the other portion, substantially only the actuating zone may deflect.

In an additional aspect, a method of dispensing a product may include providing the device for dispensing, and exerting the threshold pressure $P_s$ on the actuating wall so as to spray the product from the spray orifice. The product may include at least one of a cosmetic product and a care product. In another aspect, the method may also include directing spray of the product toward a body region (e.g., the skin, an article of clothing on the skin, and/or hair). The product may include at least one component imparting a scent to the product. For example, the product may include at least one of a perfume and a cologne. According to an additional aspect, the spraying of the product may occur for a predetermined duration of time. The volume of the product sprayed may range from about 0.01 milliliter to about 1 milliliter.

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

Aside from the structural and procedural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate exemplary embodiments of the invention and, together with the description, serve to explain some principles of the invention. In the drawings.

DESCRIPTION OF EMBODIMENTS

Figure 1:
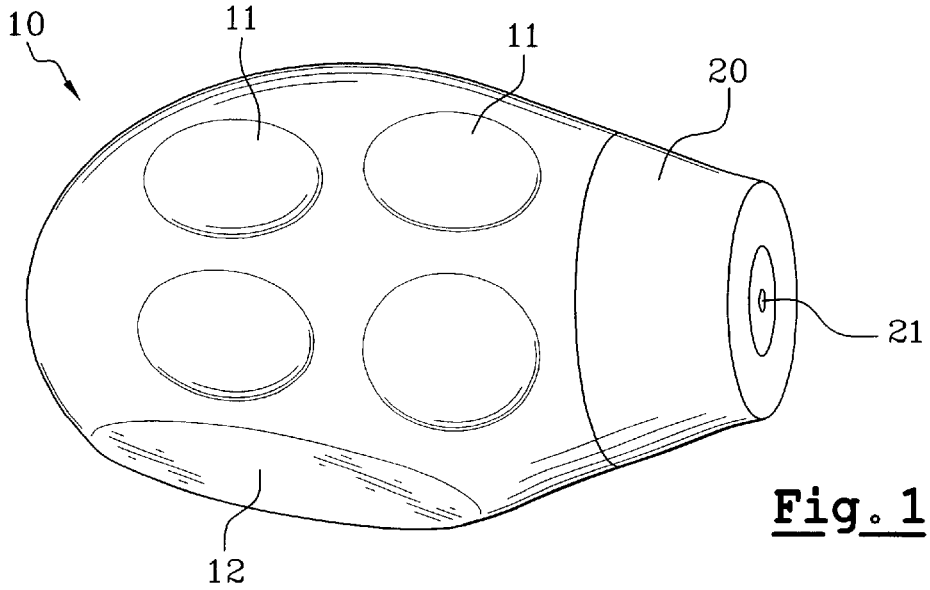
FIG. 1 is a perspective view of an embodiment of a device for dispensing a fluid product.

Reference will now be made in detail to some possible embodiments of the invention, examples of which are illustrated in the accompanying drawings. Wherever possible, the same reference numbers are used in the drawings and the description to refer to the same or like parts.

Figure 2:
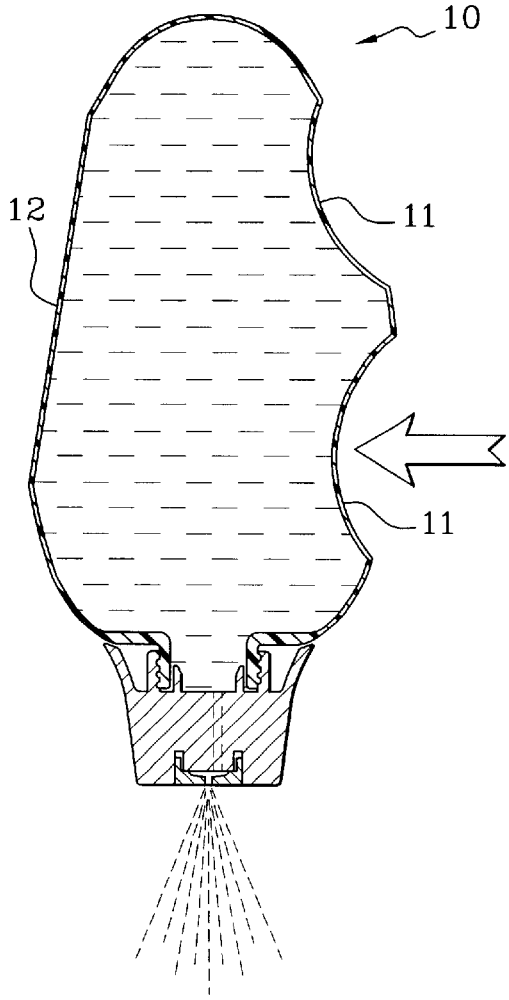
FIG. 2 is a schematic cross-section view of the device of FIG. 1 when subjected to a pressure.
Figure 3:
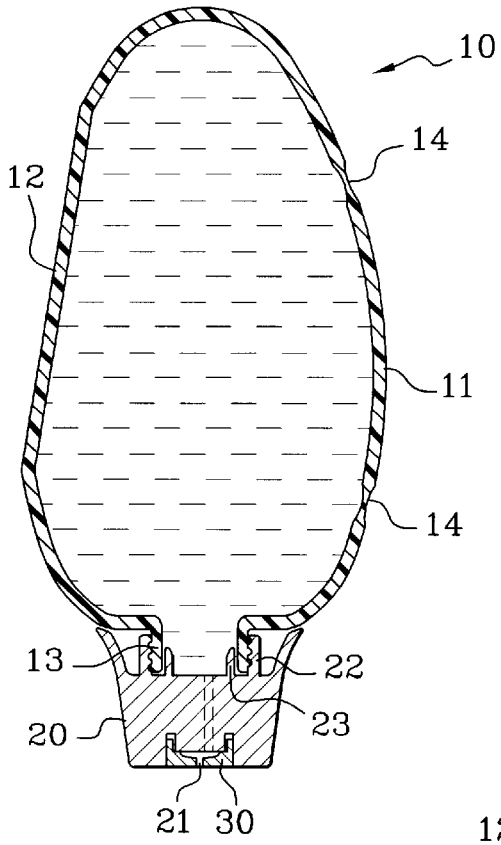
FIG. 3 is a schematic cross-section view of the device FIG. 1.

The device depicted in FIGS. 1–3 may comprise a reservoir 10 (e.g., a deformable-walled reservoir) for containing the product to be dispensed. Mounted on the reservoir 10, there may be a diffuser 20, which may include, for example, a spray orifice 21 in communication with the inside of the reservoir 10. In such an exemplary embodiment, by exerting pressure on the wall of the reservoir 10, an overpressure may be created inside the reservoir 10 which may cause the product to be sprayed through the spray orifice 21.

According to the embodiment depicted in FIGS. 1–3, the reservoir 10 may be configured in the form of a tear-drop, although the reservoir 10 may have any other shape allowing at least a portion of one of at least one of its walls to be deformed. The reservoir may be formed, for example, by molding, such as by injection blow-molding. For example, the reservoir 10 may be formed as a single piece of a thermoplastic material (e.g., the reservoir may be formed of at least one of polyethylenes, polypropylenes, polyethylene terephthalates, polyethylene naphthalates, polyacrylonitriles, polyoxymethylenes, and polyvinyl chlorides).

The reservoir 10 may include several actuating zones 11 (e.g., actuating zones having a domed-shape) which may be deformed when pressure is exerted on them. These actuating zones 11 may be configured so that they do not revert to an initial position when pressure is no longer exerted on them. In another portion of the reservoir 10 (e.g., opposite the actuating zone 11), the reservoir 10 may have a wall 12 that is substantially flat, although walls having other configurations are possible and are contemplated. Such a configuration of the reservoir 10 may render it easier to identify a zone on which the user may apply pressure so that the operation of the device may be more readily apparent. This exemplary configuration may also allow a user of the device to easily grasp the device, for example, between two fingers, with a user placing the thumb on the wall 12 and the index finger on at least one of the actuating zones 11, or vice versa. A user may thus exert pressure on at least one actuating zone 11 using his/her index finger or thumb, for example, thereby possibly spraying the product more easily.

The reservoir 10 may be provided with an open neck 13, for example, a neck having a threaded external surface. A diffuser 20 may be threaded onto the neck 13 of the reservoir 10, with the neck 13, for example, being arranged as a continuation of the wall of the reservoir 10 so as to form the end of device (e.g., when the device forms a tear-drop shape). The diffuser 20 may be fitted with a fixing skirt 22, that may be threaded on its interior surface in order to engage with the neck 13 of the reservoir 10. A cylindrical sealing skirt 23 may be configured to become lodged inside the neck 13 of the reservoir 10, and thus may afford sealing between the opening of the neck 13 and the diffuser 20. The diffuser 20 may be formed by molding (e.g., molding as a single piece) of a thermoplastic material. For example, the diffuser 20 may be formed by molding at least one of polyethylenes and polypropylenes.

A nozzle 30 (e.g., a nozzle having at least one swirl-inducing duct) may be mounted on the diffuser 20. The spray orifice 21 may be formed in the nozzle 30 and may be in communication with the interior of the reservoir 10, for example, via the interior of the neck 13. The nozzle 30 may be mounted on the diffuser 20 by any appropriate means. For example, the nozzle 30 may be mounted by at least one of bonding, welding, clamping, and snap-fastening.

According to the embodiment illustrated in FIGS. 1 and 2, the actuating zone 11 may remain in the deformed position when the pressure exerted on it ceases, for example, by virtue of the geometry of the actuating zone 11, which may be in the form of a hemisphere, for example, with a relatively small radius of curvature. In order to produce an actuating zone 11 which remains in a deformed position when pressure ceases to be exerted on it, it may be possible to use a wall having portions with a reduced thickness. For example, as shown in FIG. 3, the actuating zone 11 may be defined along a line 14 surrounding the actuating zone 11. In general, such an actuating zone 11 may be obtained by altering certain parameters of the wall, such as, for example, by altering the rigidity of the material used to form the actuating zone 11, by altering the thickness of the wall in the region of the actuating zone 11, and/or by altering the radius of curvature of the actuating zone 11. It may be possible to alter one or several of these parameters in combination.

Figure 4:
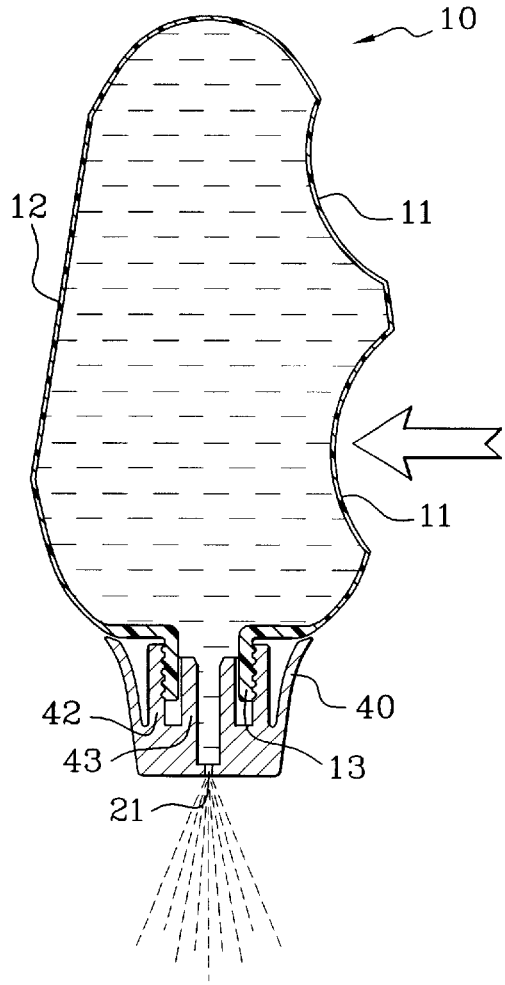
FIG. 4 is a schematic cross-section view of another embodiment of a device for dispensing a product when subjected to a pressure.

According to another embodiment, as shown in FIG. 4, a device (e.g., a spray device) may include, for example, a simple endpiece 40 equipped with a spray orifice 21 instead of a diffuser 20 equipped with the nozzle 30 as has been described previously herein. For example, the endpiece 40 may comprise a fixing skirt 42 threaded on an exterior surface so as to be threaded onto the neck 13 of the reservoir 10. The endpiece 40 may also comprise a sealing skirt 43 configured to be lodged inside the neck 13 of the reservoir 10. Such an endpiece 40 may also be used in the embodiment described in association with FIG. 3.

In the embodiments shown in FIGS. 1–4, the reservoir 10 may be configured in such a way as to generate a good quality spray. For example, an actuating zone 11 may be provided with a predetermined threshold resistance to deformation below which the actuating zone 11 may deform slightly, and beyond which, the actuating zone 11 may deform suddenly, exhibiting, for example, a concave profile, as shown in FIG. 2. This predetermined threshold resistance to deformation may be determined, for example, according to the geometry of the actuating zone 11, according to the characteristics of the material used to form the actuating zone 11, and/or according to the thickness of the actuating zone 11. For example, the reservoir 10 may change from a first convex position (e.g., a position corresponding to an undeformed position), to a second concave position (e.g., corresponding to a deformed position). This second position may be predetermined, for example, according to the geometry of the actuating zone 11. As a result, for a given reservoir 10, it may be easy to determine the deformable volume (i.e., the variation in volume between the undeformed position and the predetermined deformed position). Furthermore, the remainder of the reservoir 10 may remain substantially undeformed, which means that, for example, when the actuating zone 11 is deformed, the interior volume of the reservoir 10 decreases. An overpressure may thus be created within the reservoir 10 and may cause the product to be expelled from the nozzle 30. The overpressure may be created suddenly (e.g., when the predetermined threshold to deformation is overcome), and the product may suddenly flow out of the reservoir 10 through the spray orifice 21.

In order for the device to be able to generate spraying lasting several seconds in the deformed position, for example, the mean throughput of the nozzle 30 may be chosen, for example, according to the configuration of the reservoir 10 and/or according to the viscosity of the product that is to be sprayed.

For a given reservoir 10, the total volume of product that may be expelled from the reservoir 10 in the deformed position of the actuating zone 11 may be determined because the volume may depend at least in part on the viscosity of the product and on the maximum overpressure to which it is subjected in the deformed position. For example, for a more viscous product, the overpressure needed to spray the product may need to be higher. The maximum overpressure may be determined as a function of the deformable volume of the reservoir, which may be determined, for example, as previously explained herein. For example, if it is desirable for a maximum volume to be able to be sprayed for N seconds, then a nozzle 30 having a mean throughput less than or equal to the ratio between the maximum volume of product and N may be selected.

According to one exemplary embodiment, a reservoir 10 may be formed of, for example, polyethylene terephthalate (PET). The reservoir 10 may be provided with several actuating zones 11 which may each have, in an undeformed position, a convex profile which may become concave when changed to a deformed position. For example, at least one of the actuating zones 11 in the undeformed position may have a shape similar to a hemisphere which has a radius of curvature of about 6 millimeters. Portions of the wall of an actuating zone 11 may have a thickness of about 0.3 millimeter. In an undeformed state, the reservoir 10 may have a volume, for example, of about 7.5 milliliters, while having a deformed volume, for example, of about 0.5 milliliter. In such a case, when the actuating zone 11 is in the concave position, the volume of the reservoir 10 is about 7.0 milliliters. If the device is desired to spray (e.g., spray water) for about 5 seconds, for example, then a nozzle 30 may be chosen that has a mean throughput of about 0.1 milliliter.

The device according to some exemplary embodiments of the invention may be used to dispense any cosmetic or care products, such as make-up, perfume, cologne, dermatological substance, or pharmaceutical compositions used for treating and/or changing the appearance and/or scent of hair or skin. However, in its broadest aspects, the present invention could be used to dispense many other substances.

Furthermore, sizes of various structural parts and materials used to make the above-mentioned parts are illustrative and exemplary only, and one of ordinary skill in the art would recognize that these sizes and materials can be changed as necessary to produce different effects or desired characteristics.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device for dispensing a fluid product, the device comprising:

a reservoir configured to contain a fluid product, the reservoir comprising at least one actuating zone having a predetermined threshold resistance to deformation; and a spray orifice associated with the reservoir, wherein the actuating zone is configured to deform in response to pressure exerted on the actuating zone so as to cause the product to be sprayed out from the orifice, wherein the actuating zone is configured so that when pressure exerted on the actuating zone is less than a threshold pressure $P_s$ sufficient to overcome the predetermined threshold resistance to deformation of the actuating zone, substantially no portion of the product is sprayed from the spray orifice, and wherein the device is configured so that actuating zone deformation resulting from exertion of at least the threshold pressure $P_s$ on the actuating zone persists when the pressure exerted ceases.

2. The device of claim 1, wherein the device is configured so that deformation of the actuating zone causes the product to be sprayed from the spray orifice for a duration of at least 1 second.

3. The device of claim 1, wherein the device is configured to contain a sample dose of at least one of a cosmetic product and a care product.

4. The device of claim 1, wherein the device is configured so that deformation of the actuating zone causes the product to be sprayed from the spray orifice for a duration ranging from about 1 second to about 45 seconds.

5. The device of claim 1, wherein the device is configured so that deformation of the actuating zone causes the product to be sprayed from the spray orifice for a duration ranging from about 2 seconds to about 10 seconds.

6. The device of claim 1, wherein the actuating zone has a substantially convex profile in an undeformed position and a substantially concave profile in a deformed position.

7. The device of claim 6, wherein the actuating zone is configured to be deformed from an undeformed position to a deformed position, and wherein the actuating zone has a substantially convex profile in its undeformed position and a substantially concave profile in its deformed position, the deformed position occurring when the pressure exerted on the actuating zone reaches the threshold pressure $P_s$.

8. The device of claim 1, wherein the actuating zone is at least partially defined by a line of material on the reservoir having a reduced thickness.

9. The device of claim 1, wherein the actuating zone of the reservoir is formed of at least one layer of at least one of a thermoplastic material and a metallic material.

10. The device of claim 9, wherein the thermoplastic material is selected from polyethylenes, polypropylenes, polyethylene terephthalates, polyethylene naphthalates, polyacrylonitriles, polyoxymethylenes, and polyvinyl chlorides.

11. The device of claim 1, wherein the reservoir comprises a plurality of actuating zones.

12. The device of claim 11, wherein each of the plurality of actuating zones are configured to deform in a substantially identical manner.

13. The device of claim 11, wherein at least two of the actuating zones are configured to deform in a substantially different manner from one another.

14. The device of claim 1, further comprising a diffuser comprising a nozzle and the spray orifice, the nozzle comprising at least one swirl-inducing duct.

15. The device of claim 14, wherein the diffuser is mounted on the reservoir via one of snap-fastening and screw-fastening.

16. The device of claim 1, wherein a portion of the device defining the spray orifice is configured to induce a swirl to product sprayed from the spray orifice.

17. The device of claim 1, wherein the reservoir defines an interior volume in an undeformed state ranging from about 0.2 milliliter to about 15 milliliters.

18. The device of claim 17, wherein the reservoir defines an interior volume in a deformed state ranging from about 0.17 milliliter to about 14 milliliters.

19. The device of claim 1, wherein the difference between an interior volume of the reservoir in an undeformed state and a deformed state ranges from about 0.01 milliliter to about 2.25 milliliters.

20. The device of claim 1, wherein the difference between an interior volume of the reservoir in an undeformed state and a deformed state ranges from about 5% to about 15% of the interior volume of the reservoir in the undeformed state.

21. The device of claim 1, wherein the device is configured to provide an atomizing spray of the product from the spray orifice.

22. The device of claim 1, wherein a portion of the reservoir opposite the actuating zone defines a substantially planar surface.

23. The device of claim 1, wherein the device defines a substantially tear-drop shape.

24. The device of claim 1, wherein at least a portion of the reservoir is one of at least partially transparent and at least partially translucent.

25. The device of claim 1, wherein the reservoir comprises at least one substance imparting a color to the reservoir.

26. The device of claim 1, wherein the reservoir comprises a first portion comprising the actuating zone and at least one other portion, and wherein when the threshold pressure $P_s$ is exerted on the first portion and the other portion, substantially only the actuating zone deflects.

27. The device of claim 1, further comprising a fluid product contained in the reservoir.

28. The device of claim 27, wherein, at least prior to a first use of the device, the product has a volume ranging from about 0.5 milliliter to about 15 milliliters.

29. The device of claim 27, wherein the product comprises at least one of a cosmetic product and a care product.

30. The device of claim 27, wherein the product comprises at least one component imparting a scent to the product.

31. The device of claim 30, wherein the product comprises at least one of a perfume and a cologne.

32. The device of claim 1, wherein the device is configured so that exerting of at least the threshold pressure $P_s$ on the actuating zone causes the actuating zone to deform suddenly, thereby creating an overpressure condition within the reservoir.

33. A method of dispensing a product, the method comprising:

providing the device for dispensing of claim 27; and exerting the threshold pressure $P_s$ on the actuating zone so as to spray the product from the spray orifice.

34. The method of claim 33, wherein the product comprises at least one of a cosmetic product and a care product.

35. The method of claim 34, further comprising directing spray of the product toward a body region.

36. The method of claim 33, wherein the product comprises at least one component imparting a scent to the product.

37. The method of claim 33, wherein the product comprises at least one of a perfume and a cologne.

38. The method of claim 33, wherein the spraying of the product occurs for a predetermined duration of time.

39. The method of claim 33, wherein the exerting the threshold pressure $P_s$ results in the reservoir changing from an undeformed state to a deformed state, wherein the difference between an interior volume of the reservoir in the undeformed state and the deformed state ranges from about 0.01 milliliter to about 2.25 milliliters.

40. The method of claim 33, wherein the exerting the threshold pressure $P_s$ results in the reservoir changing from an undeformed state to a deformed state, wherein the difference between an interior volume of the reservoir in the undeformed state and the deformed state ranges from about 5% to about 15% of the interior volume of the reservoir in the undeformed state.

41. The method of claim 33, wherein the volume of the product sprayed ranges from about 0.01 milliliter to about 2.25 milliliters.

* * * * *